US011566609B2

(12) United States Patent
Bais

(10) Patent No.: US 11,566,609 B2
(45) Date of Patent: Jan. 31, 2023

(54) PORTABLE AIR PUMP WITH RAPID INFLATION

(71) Applicant: John Michael Bais, Winnipeg (CA)

(72) Inventor: John Michael Bais, Winnipeg (CA)

(73) Assignee: BASELINE DESIGN INNOVATIONS INC., Victoria (CA)

( * ) Notice: Subject to any disclaimer, the term of this patent is extended or adjusted under 35 U.S.C. 154(b) by 432 days.

(21) Appl. No.: 16/740,437

(22) Filed: Jan. 11, 2020

(65) Prior Publication Data

US 2020/0224648 A1 Jul. 16, 2020

Related U.S. Application Data

(60) Provisional application No. 62/791,214, filed on Jan. 11, 2019.

(51) Int. Cl.
*F04B 33/00* (2006.01)

(52) U.S. Cl.
CPC ..... *F04B 33/00* (2013.01)

(58) Field of Classification Search
CPC ..... F04B 33/00
See application file for complete search history.

(56) References Cited

U.S. PATENT DOCUMENTS 2,423,890 A * 7/1947 Hurt ..... A47C 27/084 52/2.26
3,845,795 A * 11/1974 Andreasson ..... F04B 45/02 141/391
4,674,532 A * 6/1987 Koyanagi ..... A63H 27/10 446/224
5,145,338 A * 9/1992 Murray ..... F04B 43/08 92/92
5,230,611 A * 7/1993 Shelton ..... F04B 33/00 417/437
5,500,014 A * 3/1996 Quijano ..... A61F 2/2418 623/1.24
5,692,836 A * 12/1997 Mitchell ..... B65F 1/062 383/41
6,019,122 A * 2/2000 Chen ..... F16K 15/202 137/846
6,176,758 B1 * 1/2001 Wu ..... A63H 27/10 446/224
10,405,663 B2 * 9/2019 Yang ..... A47C 4/54
10,640,186 B2 * 5/2020 Haynes ..... B64D 25/14
10,816,101 B2 * 10/2020 Bais ..... F16K 15/147
11,247,755 B2 * 2/2022 Schuyler ..... B63C 9/00
2004/0064892 A1 * 4/2004 Ledvina ..... A47G 9/1027 5/644
2005/0061409 A1 * 3/2005 Chung ..... A45C 7/0081 383/3
2008/0072540 A1 * 3/2008 Miller ..... F04B 33/00 53/403

(Continued)

*Primary Examiner* — Thomas Fink

(57) ABSTRACT

An improved human-powered air pump allowing rapid low pressure and high pressure inflation has an expandable/collapsible first and second chamber featuring and airflow path via a one-way valve. Said first chamber features an air intake. Said one-way valve allows air to flow in a downstream direction. Said pump features an outlet configured to receive air from said second chamber and connectable to an inlet of an inflatable object to feed air thereto from said pump.

20 Claims, 5 Drawing Sheets

(56) References Cited

U.S. PATENT DOCUMENTS

| | | | | |
|---|---|---|---|---|
| 2008/0121307 | A1* | 5/2008 | Liao | F16K 15/147<br>141/198 |
| 2008/0160371 | A1* | 7/2008 | Spahr | C01B 3/065<br>429/513 |
| 2011/0030819 | A1* | 2/2011 | Chan | F04B 33/00<br>137/511 |
| 2014/0209184 | A1* | 7/2014 | Frayne | F16K 15/20<br>137/223 |
| 2015/0150383 | A1* | 6/2015 | Frayne | A47C 27/088<br>5/706 |
| 2017/0225872 | A1* | 8/2017 | Collie | A45C 11/22 |
| 2017/0292511 | A1* | 10/2017 | Frayne | F04B 45/06 |
| 2017/0295914 | A1* | 10/2017 | Evatt | A45F 3/20 |
| 2021/0361054 | A1* | 11/2021 | Huang | A45F 4/06 |

* cited by examiner

PORTABLE AIR PUMP WITH RAPID INFLATION

FIELD OF INVENTION

Inflatable objects such as traction kites, rafts, stand up paddle boards, pool toys, sports balls, and the like, offer a benefit of being light weight while maintaining a shape then being deflated for easy transportation and storage. A pump is typically used for inflation. Adequate air pressure is important to achieve proper performance.

BACKGROUND

Major benefits of inflatable objects include being lightweight and holding a rigid shape and then compacting down to allow easy transportation and storage. This makes inflatable objects an excellent option when storage space is a premium traveling to the destination where the inflatable objects will be inflated for use. Traditional T-handle air pumps that are large enough to allow rapid inflation are bulky and have an awkward shape that can damage other packed items. Small foot/hand pumps are slow and don't allow rapid inflation. Large bag-like pumps can have limited pressure capabilities. Electric pumps are either large and heavy or small and slow. Furthermore, destinations where it's desirable to bring inflatable objects may not have power sources readily available and bringing stored power adds considerable weight.

In conclusion, insofar as I am aware, no pump for inflatable objects formerly developed matches the benefits of the inflatable object (lightweight and compact) while being able to rapidly inflate inflatable object to the adequate pressure requirement for traction kites, rafts, stand up paddle boards and the like.

SUMMARY

An improved air pump for inflatable objects either has at least two compressible chambers, a large chamber and small chamber. Air can be rapidly captured in the large chamber through an opening that can either be closed or have a one-way valve to prevent air from exiting the large opening on the large chamber. The small chamber has an inlet that connects to the large chamber via a check valve, where the check valve allows air to flow from the large chamber to the small chamber, and an outlet that leads to the inlet of an inflatable object and may include various check valves, hoses, or adaptors.

The pump is capable of rapidly inflating inflatable objects with pressure that is sufficient for structural support of inflatable traction kites, rafts, stand up paddle boards, pool toys, sports balls, etc. Inflation is split into sequences, rapid low pressure inflation and high pressure inflation.

To inflate with rapid low pressure, a large opening on the large chamber is used to quickly capture a large volume of air. Then the large opening or one-way valve is closed to prevent air from escaping. A user can apply pressure to the large chamber possibly by pushing, squeezing, sitting, kneeling or any other suitable means. Air in the large chamber is then forced through the check valve, small chamber and any various check valves, hoses or adaptors to the inlet of the inflatable object. More air can be added to the large chamber and the process repeated until the desired pressure is achieved or until switching to high-pressure inflation.

To inflate in high pressure mode, a force on large chamber fills the small chamber with air. Then the small chamber can be rapidly compressed, possibly by a user's foot or hand, to force air into the inflatable object. Air can be added to the large chamber as needed. These steps are repeated until adequate pressure is achieved in the inflatable object.

Accordingly, several advantages are to provide an improved human powered air pump that is lightweight and compact while being able to rapidly inflate inflatable object to an adequate air pressure requirement for traction kites, rafts, stand up paddle boards, sports balls and the like. Still further advantages will become apparent from a study of the following description and the accompanying drawings. Several other embodiments are described that can be used to achieve similar results while maintaining the spirit and scope of the disclosed.

DETAILED DESCRIPTION

Various pump embodiments are discussed in detail below. While specific implementations are discussed, it should be understood that this is done for illustration purposes only. A person skilled in the relevant art will recognize that other components and configurations may be used without parting from the spirit and scope of the disclosure.

The following description of various embodiments relates to lightweight, compact, human powered pumps. These pump embodiments allow rapid inflation with a capability to obtain adequate pressure required for traction kites, rafts, stand up paddle boards, pool toys, sports balls, and the like.

Figure 1A:
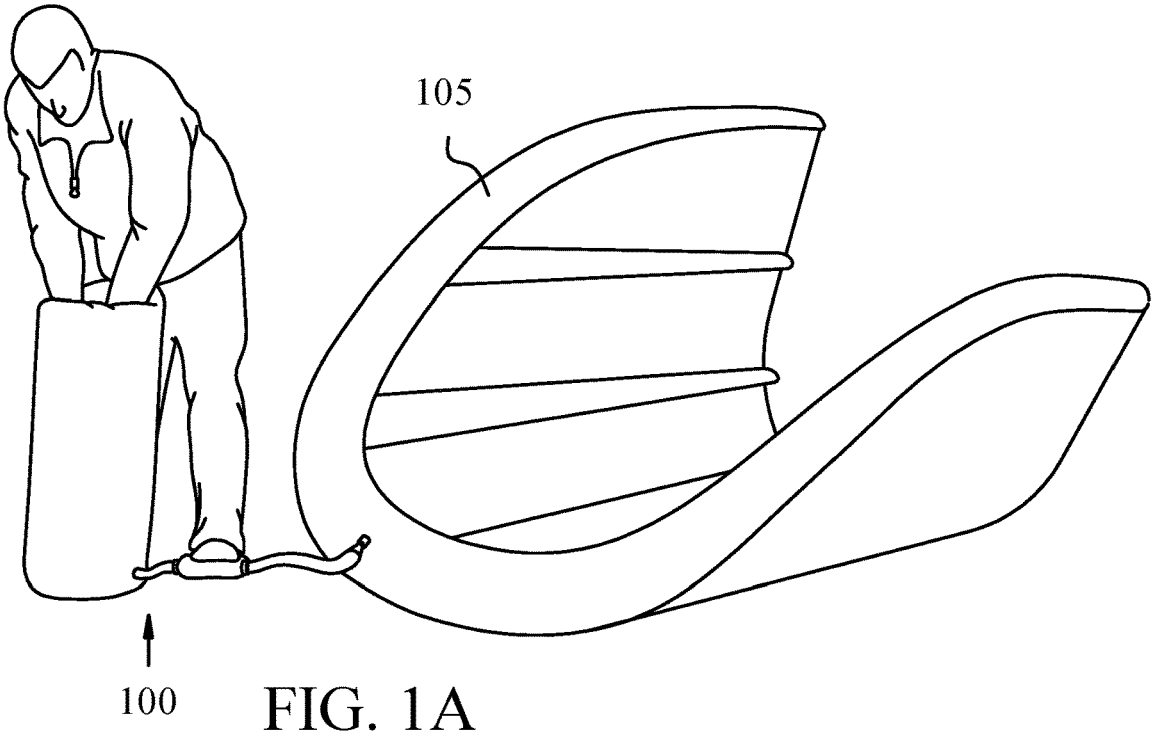
FIG. 1A-1G show exemplary embodiment pump arrangement 100

FIG. 1A shows exemplary embodiment pump arrangement 100 being used to inflate inflatable traction kite 105. Inflatable traction kite 105 is a representation of any inflatable object to be inflated.

Figure 1B:
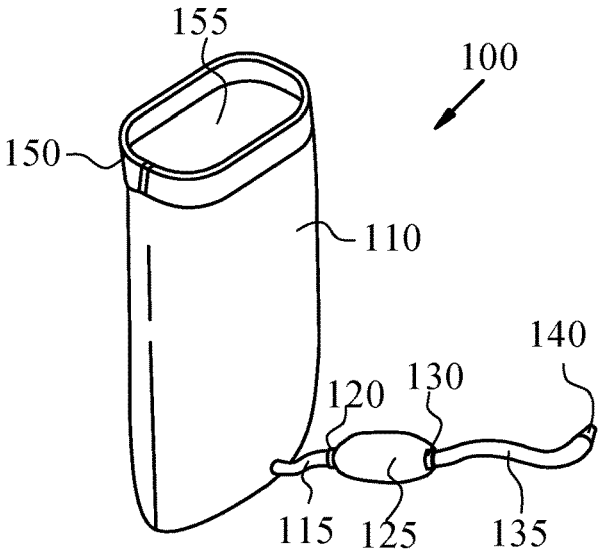
Figure 1C:
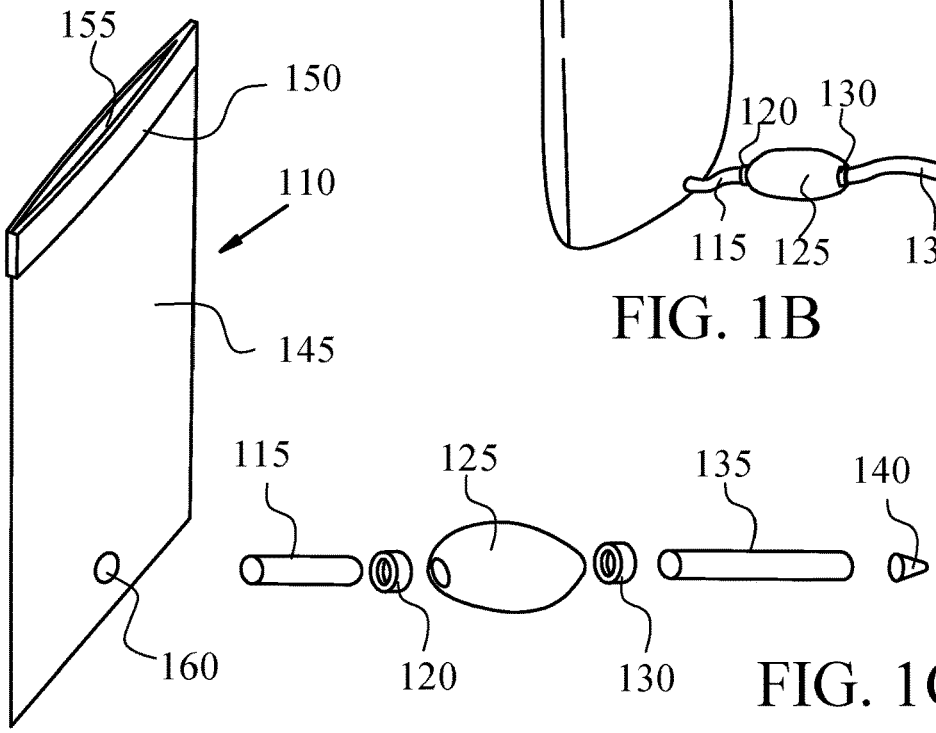

As illustrated in FIG. 1B, pump arrangement 100 is a bag-like pump that includes first chamber 110, connector hose 115, first one-way valve 120, second chamber 125, second one-way valve 130, outlet hose 135 and adapter 140. FIG. 1C shows an exploded view of pump arrangement 100 and shows how these parts are connected in a chain. These connections can be made with any method known in the art and may include connections that can be coupled and uncoupled.

Figure 1D:
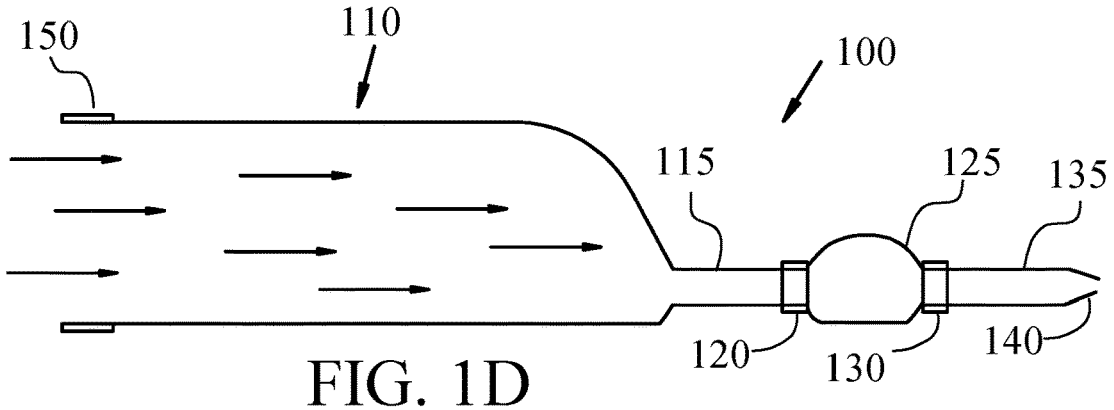

First chamber 110 is similar to a dry bag and includes chamber body 145, resilient member 150, intake opening 155, and outlet hole 160. As shown in FIG. 1D, when first chamber 110 is in an air-filled state its internal space is expanded to a volumetric size that may be large enough so that a user could push on it with their arms as shown in FIG. 1A. Resilient member 150 makes it easier to roll the top of chamber body 145 to close intake opening 155. Resilient member 150 can be made from a thin flexible sheet such as a plastic, composite, card stock, etc. Resilient member 150 can also be replaced with anything that will have a greater stiffness then chamber body 145, such as a hem around intake opening 155. Outlet hole 160 is located near the opposite end of first chamber 110 away from intake opening 155 and will connect to one end of connector hose 115.

Chamber body 145 can be made from any impermeable or mostly impermeable flexible sheet known in the art such as; nylon, vinyl, rubber, polyurethane, etc.

Connector hose 115 and outlet hose 135 and can be any resilient tubes that allow air to pass through know in the art and are of adequate length to allow for user ergonomics and may not be required at all for some embodiments. Connector hose 115 provides an airflow path from outlet hole 160 and into second chamber 125 via first one-way valve 120. Outlet hose 135 provides an airflow path from second chamber 125 and into adapter 140 via second one-way valve 130.

Figure 1E:
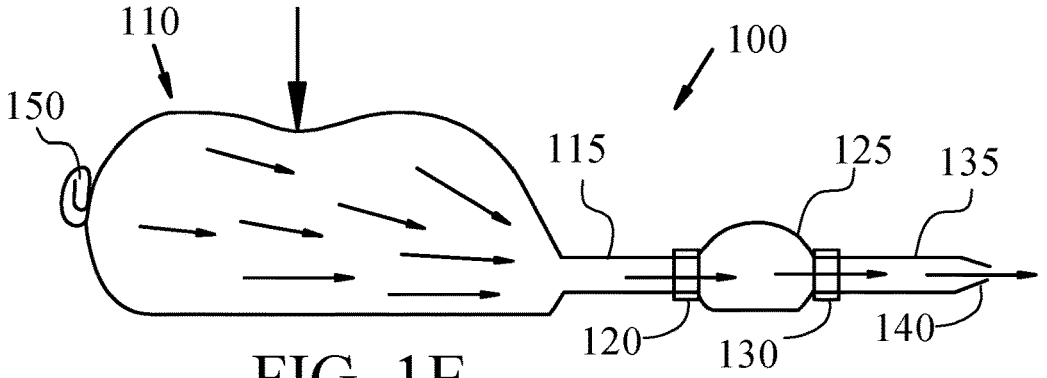

Second chamber 125 is a flexible bag that can be made from any impermeable or mostly impermeable flexible sheet known in the art such as; nylon, vinyl, rubber, polyurethane, etc. Second chamber 125 includes two holes on opposing sides that are of appropriate size to connect first one-way valve 120 and second one-way valve 130. As shown in FIG. 1G, when second chamber 125 is in an air-filled state its internal space is expanded to a volumetric size that may be small enough that it could approximately fit into the profile of a user's foot or hand print. Preferably, an axial length of second chamber 125 from its inlet hole where first one-way valve 120 resides to its opposing outlet hole where second one-way valve 130 or outlet hose 135 resides is at least 3 inches long, and more preferably at least 5 inches long; and preferably doesn't exceed 9 inches long, and more preferably doesn't exceed 8 inches long. Preferably a width of second chamber 125, measured perpendicularly of the axial length thereof, is at least 2 inches wide, and more preferably at least 4 inches wide; and preferably doesn't exceed 9 inches wide, and more preferably doesn't exceed 7 inches wide.

While pump arrangement 100 uses a baglike body for first chamber 110 and second chamber 125 so that all the chamber walls are flexible to allow compression of the interior space of first chamber 110 and second chamber 125 from any and all sides, there could be other embodiments in which either chamber body is partially formed of more rigid material, provided that at least one side of the overall body is flexible to allow for the chamber compression by the user.

Either of first one-way valve 120 or second one-way valve 130 can be any one-way valve known in the art. First one-way valve 120 is connected to one hole in second chamber 125 while second one-way valve 130 is connected to the other hole in second chamber 125. Both first one-way valve 120 or second one-way valve 130 are in an orientation that will allow air to flow from first chamber 110 to adapter 140 and restrict flow in the opposite direction.

Adapter 140 provides an airflow path from outlet hose 135 to inflatable traction kite 105. This can be a plastic nozzle that is connected at one end to outlet hose 135 and can be coupled and uncoupled to and from the intake of inflatable traction kite 105. Adapter 140 can also be made from any suitable coupler allowing an airflow path known in the art.

Inflation is split into two sequences, first rapid low pressure inflation and then high pressure inflation. To inflate an inflatable object such as inflatable traction kite 105 with pump arrangement 100, adapter 140 is connected to the inflation valve of the inflatable object as seen in FIG. 1A.

Rapid low pressure inflation starts by capturing air in first chamber 110. This can be done with several methods such as, but not limited to, holding intake opening 155 open while pulling first chamber 110 through the air, holding intake opening 155 open into the wind, the user blowing a stream of air towards the intake opening 155 cause a venture effect to rapidly fill first chamber 110, etc. FIG. 1D shows a cross sectional view of pump arrangement 100 filling with air through intake opening 155. Then intake opening 155 can be closed by rolling resilient member 150 enough times that air is restricted from exiting first chamber 110 through intake opening 155. Then resilient member 150 is held by the user in that closed rolled position.

Then the user can begin rapid inflation by applying a force on first chamber 110. The force could be applied to first chamber 110 in the form of the user pushing down with their arms, squeezing, sitting, kneeling or by any other suitable means. As seen in cross sectional view FIG. 1E this will force air through connector hose 115, first one-way valve 120, second chamber 125, second one-way valve 130, outlet hose 135 and adapter 140 then into the inflatable object. The steps shown in FIG. 1D and FIG. 1E can be repeated as many times as required before switching to high pressure mode.

Figure 1F:
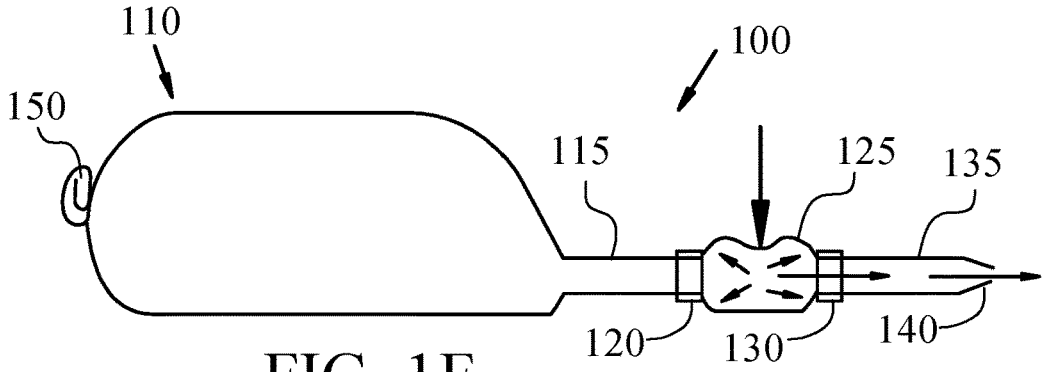
Figure 1G:
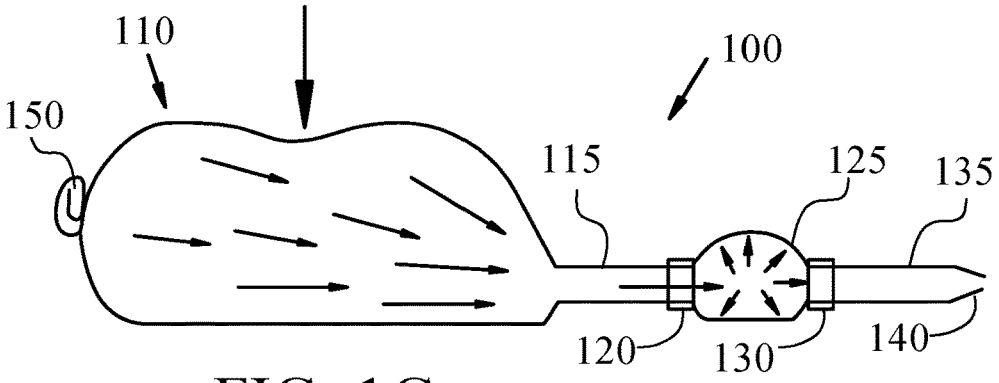

High pressure inflation starts by applying a force onto second chamber 125 (FIG. 1F). The force could be in the form of the user's body weight such as stepping, stomping, or any other suitable means. The increased pressure inside second chamber 125 will close first one-way valve 120 and force the air through second one-way valve 130 (FIG. 1F). When the force is removed from second chamber 125, second one-way valve 130 will close due to the higher pressure now in outlet hose 135 and restrict air from back flowing into second chamber 125. The user can apply pressure to first chamber 110 to re-inflate second chamber 125 (FIG. 1G). The steps from FIG. 1F and FIG. 1G can be repeated until the desired pressure in the inflatable object is achieved, refilling first chamber 110 through intake opening 155 as needed. The user can also apply a constant force to first chamber 110 while rapidly stepping on second chamber 125 for high pressure inflation.

Since the user is applying pressure to first chamber 110 to inflate second chamber 125 (FIG. 1G) air in second chamber 125 can be higher than atmospheric pressure. Therefore a larger mass of air is compressed into the inflatable object with every pump of second chamber 125 compared to using atmospheric pressure. This means faster inflation and fewer pumps of second chamber 125 are needed to create the same pressure compared to using atmospheric pressure or lower.

Some embodiments similar to pump arrangement 100 include a large one-way valve where air initially enters the embodiment to assist initial air capture. Additionally some embodiments may not require a one-way valve after the small chamber if the inflatable object's intake valve includes a way to restrict air from exiting the inflatable object.

Figure 2A:
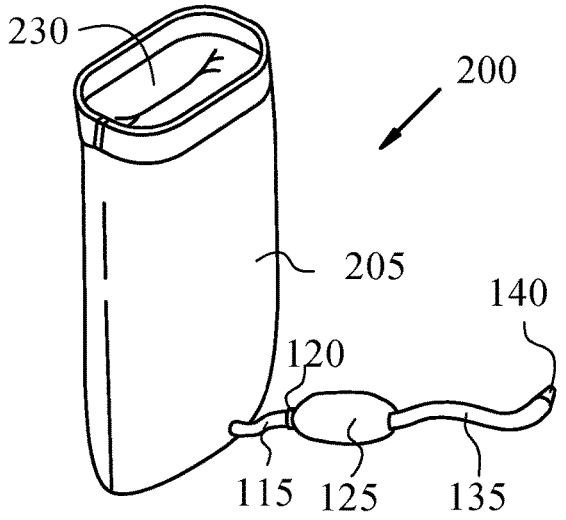
FIG. 2A-2H show exemplary embodiment pump arrangement 200
Figure 2B:
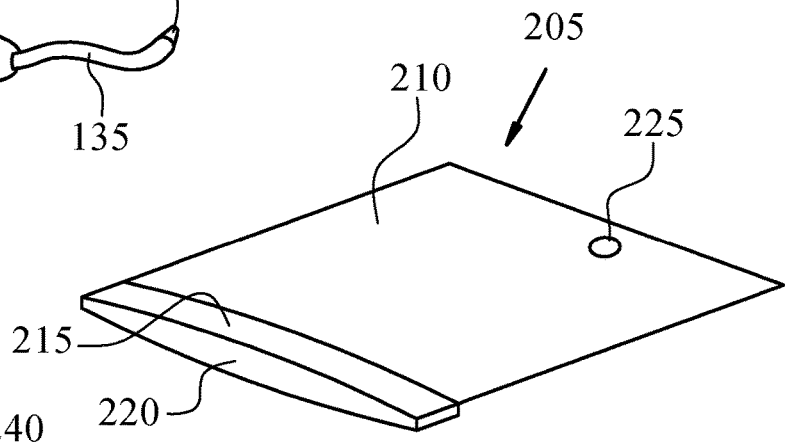

Pump arrangement 200 is similar to pump arrangement 100 but includes one-way intake valve 230 and first chamber 205 in place of first chamber 110. FIG. 2B shows first chamber 205 which is similar to first chamber 110 but includes chamber body 210, resilient member 215, intake opening 220 and outlet hole 225 instead of chamber body 145, resilient member 150, intake opening 155 and outlet hole 160 respectively. Additionally pump arrangement 200 only includes first one-way valve 120 and does not include second one-way valve 130 and is intended to be used to inflate inflatable objects that have a one-way valve included in their intake valves.

Figure 2C:
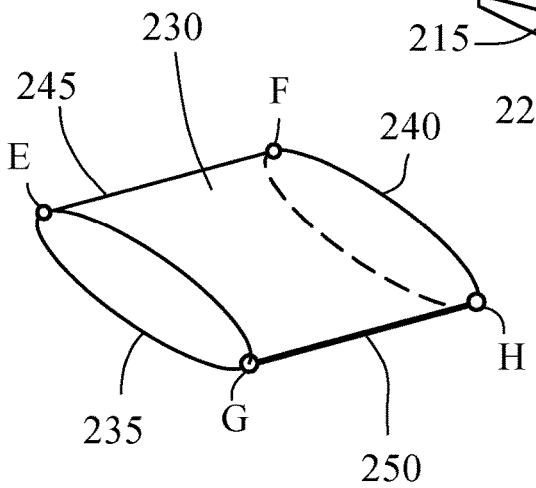

FIG. 2C shows one-way intake valve 230 as a flexible tube which includes outside edge 235, inside edge 240, side edge 245 and side edge 250. Side edge 245 and side edge 250 span the distance from point E to F and point G to H respectively. One-way intake valve 230 may be made of a flexible sheet material similar to first chamber 205 or any impermeable or mostly impermeable flexible sheet known in the art such as; nylon, vinyl, rubber, polyurethane, etc. Improved performance is seen from materials that form an air resistance seal when pressed against itself such as polyurethane, rubber, vinyl, etc.

Figure 2D:
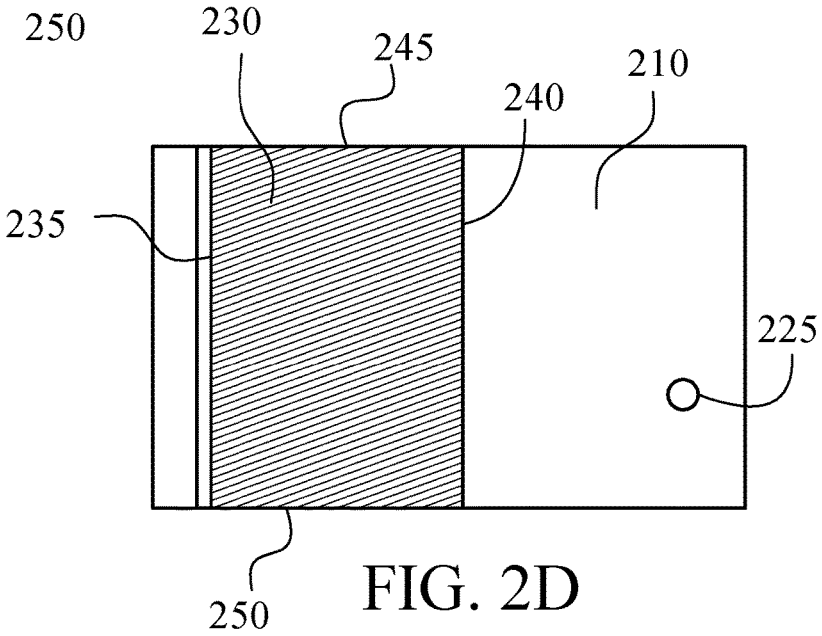

FIG. 2D shows one-way intake valve 230 connected to first chamber 205. One-way intake valve 230 is located inside of chamber body 210 and oriented with outside edge 235 closer to intake opening 220 and inside edge 240 further away from intake opening 220. The full length of outside edge 235 is attached to the inside surface of chamber body 210 on a parallel plane to intake opening 220 so that all air that passes through intake opening 220 must also pass through one-way intake valve 230. Portion of or the full lengths of side edge 245 and side edge 250 are attached on opposite sides of the inside surface of chamber body 210 along a perpendicular plane to intake opening 220. All connections can be made with any method known in the art. Inside edge 240 is not connected and is allowed to move freely.

Figure 2E:
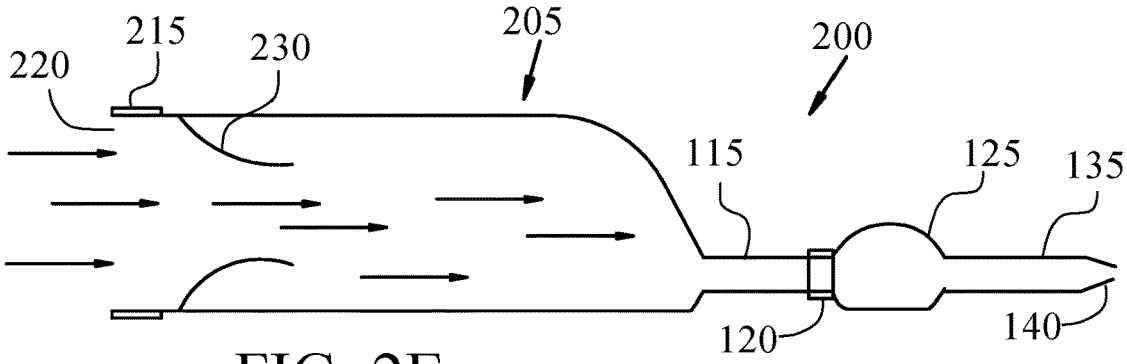
Figure 2F:
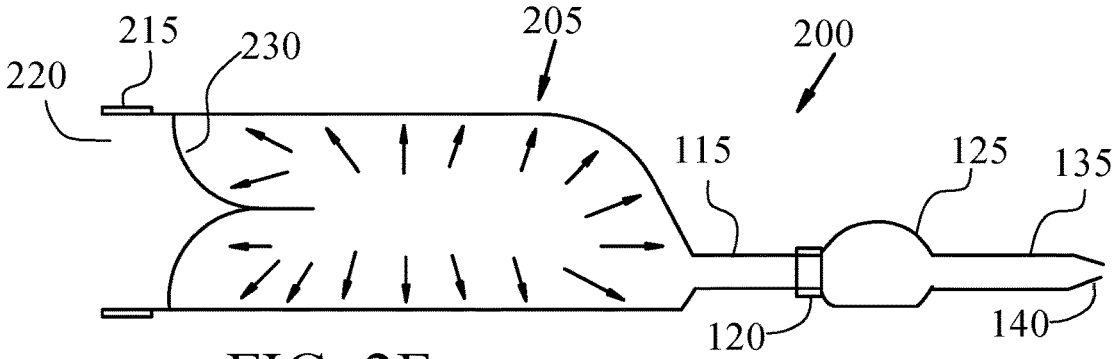
Figure 2G:
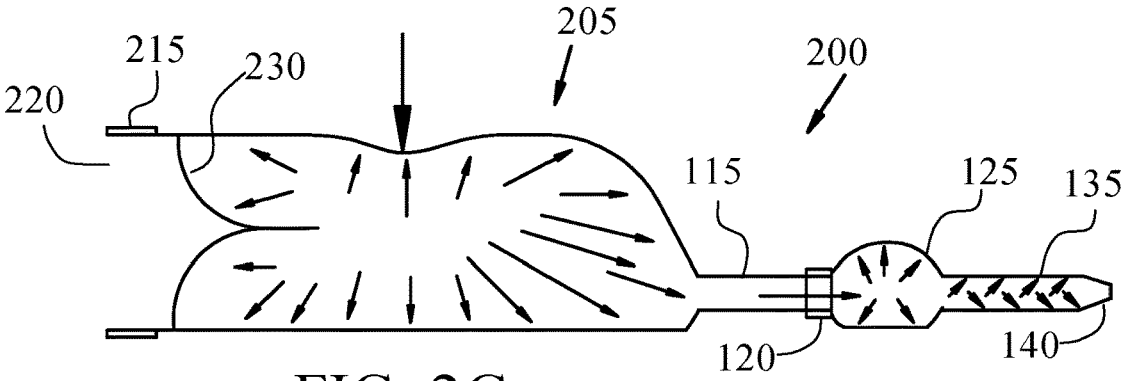
Figure 2H:
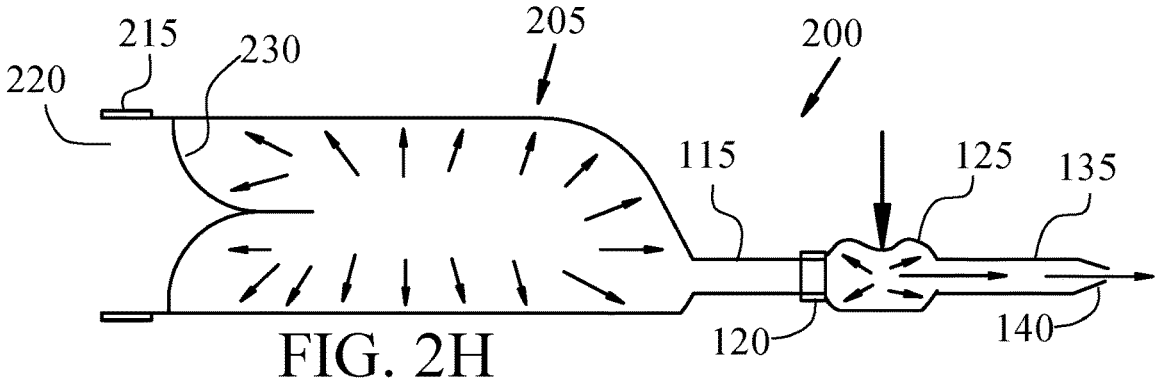

FIG. 2E-FIG. 2H show sectional views of pump arrangement 200. When the air pressure at outside edge 235 is adequately greater than the air pressure at inside edge 240 then one-way intake valve 230 will move into an open position (FIG. 2E). At this point air will flow through one-way intake valve 230 into first chamber 205. When the air pressure at inside edge 240 is greater than at outside edge 235, air flowing towards outside edge 235 will cause one-way intake valve 230 to collapse into a closed position (FIG. 2F) and air will be restricted from leaving first chamber 205 through intake opening 220. The length of side edge 245 and side edge 250 must be long enough compared to outside edge 235 and inside edge 240 that when in the closed position (FIG. 2F) inside edge 240 will come together. If the ratio is too small inside edge 240 will not come together and an opening will allow air to escape.

Inflating with pump arrangement 200 is similar to inflating with pump arrangement 100 except that when initial air is captured in first chamber 205 through intake opening 220 then one-way intake valve 230 will restrict air from escaping back through intake opening 220 as show in FIG. 2E-FIG. 2H. Therefore is it not required that resilient member 215 be rolled to close intake opening 220 before completing the rest of the pumping sequence.

Some embodiments may include a way to anchor a pump embodiment to the ground or attach the embodiment to the user. This can be usefully when the embodiment is used in windy conditions or the like. This may include, but is not limited to a pouch that can be filled with weight, a flap that can have ballast material placed on top, a tether going from the pump to the user, a tether that can accommodate a stake driven into the ground, etc.

Figure 3:
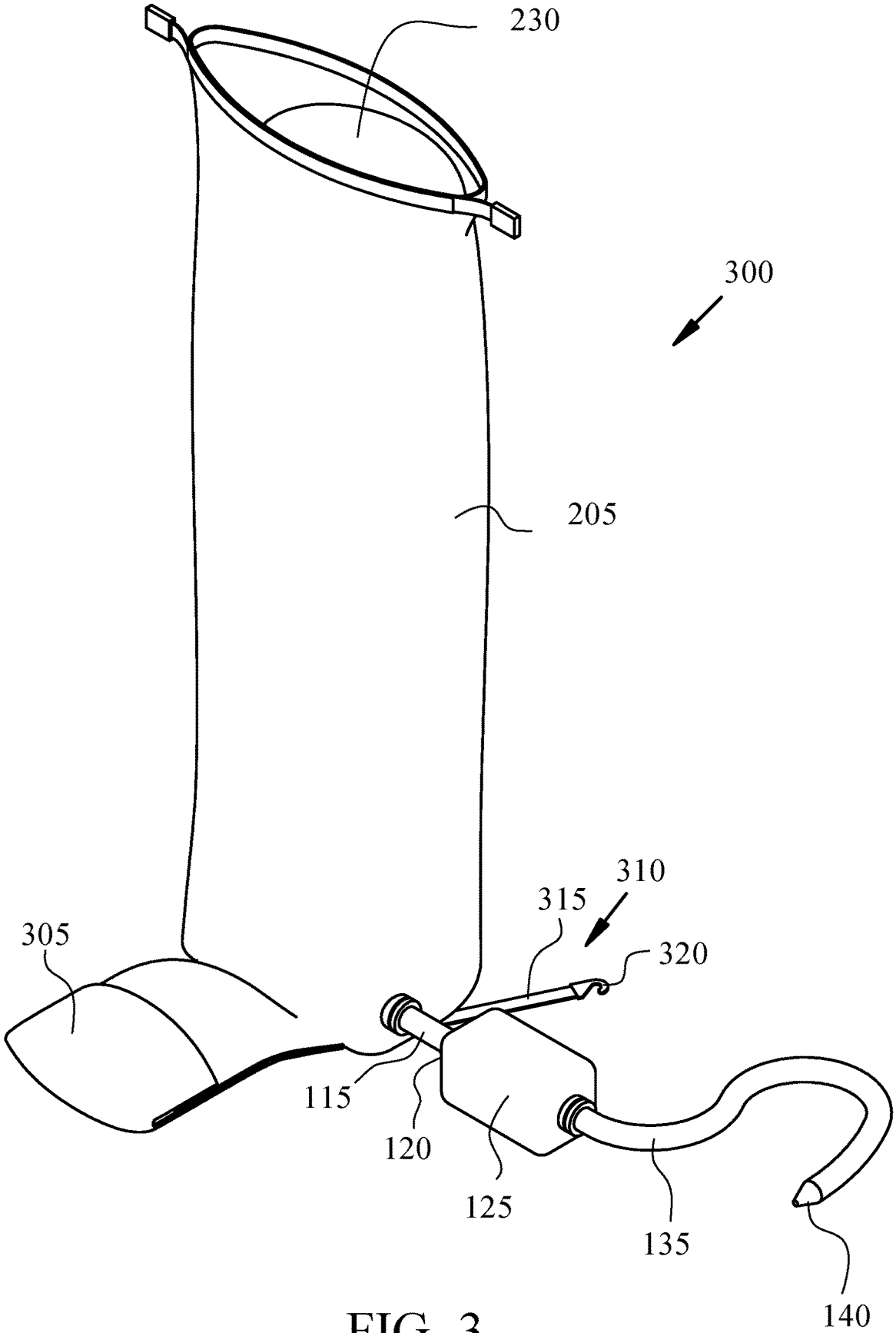
FIG. 3 show exemplary embodiment pump arrangement 300

FIG. 3 shows pump arrangement 300 which is similar to pump arrangement 200 but also includes pouch 305 and leash 310. Pouch 305 is a chamber that has at least one opening and can be filled with heavy objects such as sand, rocks, snow, tools, etc., whereby such weighted objects or ballast material is effective to anchor pump arrangement 300 in place in windy conditions. Pouch 305 can alternatively be anchored by weighted objects or ballast material being placed on top of it or by the user's weight on it. Pouch 305 is connected to the bottom of pump arrangement 300 and can be made from a similar material as first chamber 205 or any material know in the art. Leash 310 includes strap 315 and coupler 320. Strap 315 can be made from a strap like material such as webbing, rope, cord, etc. and can be connected to the bottom of pouch 305 on one end and to coupler 320 on the other end with any connection know in the art such as sewing, gluing, high frequency welding, etc. Coupler 320 can be a rigid hook, as show in FIG. 3, or any other suitable coupler known in the art made from plastic, metal, etc. and can be coupled and uncoupled to and from the inflatable object. Leash 310 allows the user to anchor the inflatable object with pump arrangement 300 in windy conditions. Inflation with pump arrangement 300 is similar to pump arrangement 200.

Some embodiments may have a simple flap, for example formed of a single flexible sheet, instead of pouch 305, whereby the pump arrangement 300 can be anchored to the ground by having the weighted objects or ballast material placed on top the flap, or by having the user exert some or all of their body weight on top of the flap, whether in a seated, standing, kneeling or other position.

The above description of various embodiments relates to lightweight, compact, human powered pumps. These pump embodiments allow rapid inflation with a capacity to obtain adequate pressure required for traction kites, rafts, stand up paddle boards, sports balls, etc. While specific implementations were discussed, it should be understood that this was done for illustration purposes only. A person skilled in the relevant art will recognize that other components and configurations may be used without parting from the spirit and scope of the disclosure.

The invention claimed is:

1. A human-powered air pump comprising:

an expandable/collapsible first chamber body delimiting a first internal space and configured to limit expansion thereof to a first volumetric size, said first chamber body having an intake opening by which air is admissible to said first internal space from an external environment outside the air pump, and an outlet from said first chamber body that is of smaller size than said intake opening and is situated distally therefrom;

a pouch or a flap connected directly to the bottom of said first chamber body, said pouch configured to enable placement of weight in or on said pouch to weigh down the air pump during use, said flap configured to enable placement of weight on said flap to weigh down the air pump during use;

an expandable/collapsible second chamber body delimiting a second internal space and configured to limit expansion thereof to a second volumetric size of lesser expanse than said first volumetric size; an airflow path leading into the second internal space from said first internal space via the outlet of the first chamber;

a one-way valve operably installed in said airflow path and configured to allow airflow between the first and second internal spaces in only a downstream direction from said first internal space to said second internal space; and a pump outlet configured to receive air from the second internal space, and connectable to an inlet of an inflatable object to feed air thereto from said second internal space.

2. The air pump of claim 1 further comprising a connecting hose connected between the first and second chambers to pass air therebetween in the downstream direction through said one-way valve.

3. The air pump of claim 1 further comprising a second one-way valve operably installed between the second chamber and the pump outlet and configured to allow airflow between the second internal space and the pump outlet in only said downstream direction.

4. The air pump of claim 1 further wherein the pump outlet comprises an outlet hose configured for connection to the inlet of the inflatable object to route air thereto from the second internal space.

5. The air pump of claim 4 wherein the pump outlet further comprises an adapter on said outlet hose by which connection is made of said outlet hose to the inlet of the inflatable object.

6. The air pump of claim 3 wherein the pump outlet comprises a hose connected to the second one-way valve to receive air from the second internal space through the second one-way valve.

7. The air pump of claim 6 wherein the pump outlet further comprises an adapter installed at an end of said hose opposite the second one-way valve.

8. The air pump of claim 1 wherein the first chamber body comprises flexible sheeting that delimits the intake opening at one end of said sheeting, and a member of greater stiffness than said flexible sheeting that is attached to said sheeting at said end thereof to border said intake opening and enable closure of the intake opening by rolling of said flexible sheeting about said member.

9. The air pump of claim 1 further comprising a one-way intake valve installed in the first chamber body adjacent the intake opening thereof.

10. The air pump of claim 9 wherein said one-way intake valve comprises a tubular member that is formed of flexible sheeting and has an outside edge situated adjacent the intake opening, an inside edge situated further from said intake opening, and two opposing side edges running from said outside edge to said inside edge, wherein said outside edge is seamed over a full length thereof to an interior of the first chamber body, and said two opposing side edges are also seamed to said interior of the first chamber body over at least a partial length of said two opposing side edges.

11. The air pump of claim 1 further comprising a leash connected to a portion of the air pump, and arranged for additional connection of the leash to the inflatable object to anchor the inflatable object to the air pump.

12. The air pump of claim 11 wherein said leash is secured, directly or indirectly, to the first chamber body, but independently of the second chamber body.

13. The air pump of claim 12 wherein said leash is connected to the first chamber body at or proximate an end thereof opposite the intake opening.

14. The air pump of claim 11 wherein the leash has a coupler thereon for coupling to the inflatable object.

15. A method of providing a human-powered air pump, the method comprising:

providing an expandable/collapsible first chamber body delimiting a first internal space and configured to limit expansion thereof to a first volumetric size, said first chamber body having a top and a bottom and having an intake opening at the top by which air is admissible to said first internal space from an external environment outside the air pump, and providing an outlet from said first chamber body that is of smaller size than said intake opening and is situated distally therefrom, providing a pouch or a flap connected directly to the bottom of said first chamber body, said pouch configured to enable placement of weight in or on said pouch to weigh down the air pump during use, said flap configured to enable placement of weight on said flap to weigh down the air pump during use:

providing an expandable/collapsible second chamber body delimiting a second internal space and configured to limit expansion thereof to a second volumetric size of lesser expanse than said first volumetric size;

providing an airflow path leading into the second internal space from said first internal space via the outlet of the first chamber:

providing a one-way valve operably installed in said airflow path and configured to allow airflow between the first and second internal spaces in only a downstream direction from said first internal space to said second internal space; and providing a pump outlet configured to receive air from the second internal space, and connectable to an inlet of an inflatable object to feed air thereto from said second internal space.

16. The method of claim 15 further comprising: providing a second one-way valve operably installed between the second chamber and the pump outlet and configured to allow airflow between the second internal space and the pump outlet in only said downstream direction.

17. The method of claim 15 further comprising:

providing an outlet hose at the pump outlet, the outlet hose configured for connection to the inlet of the inflatable object to route air thereto from the second internal space, and providing an adapter on said outlet hose by which connection is made of said outlet hose to the inlet of the inflatable object.

18. The method of claim 15 wherein the first chamber body comprises flexible sheeting that delimits the intake opening at one end of said sheeting, and providing a member of greater stiffness than said flexible sheeting that is attached to said sheeting at said end thereof to border said intake opening and enable closure of the intake opening by rolling of said flexible sheeting about said member.

19. The method of claim 15 further comprising: providing a one-way intake valve installed in the first chamber body adjacent the intake opening thereof.

20. The method of claim 15 further comprising:

providing a leash connected to a portion of the air pump, and arranged for additional connection of the leash to the inflatable object to anchor the inflatable object to the air pump.

* * * * *